US005963990A

United States Patent [19]

White

[11] Patent Number: 5,963,990

[45] Date of Patent: Oct. 12, 1999

[54] RELEASABLE GRIP FACEMASK FOR HELMET

[76] Inventor: Michael D. White, 1801 Crystal Dr. No. 718, Arlington, Va. 22202

[21] Appl. No.: 08/835,930

[22] Filed: Apr. 11, 1997

Related U.S. Application Data

[63] Continuation-in-part of application No. PCT/US96/16838, Oct. 17, 1996

[60] Provisional application No. 60/005,769, Oct. 20, 1995.

[51] Int. Cl.[6] ..... A42B 3/18

[52] U.S. Cl. ..... 2/424; 2/9

[58] Field of Search ..... 2/410, 411, 424, 2/425, 9, 10, 15

[56] References Cited

U.S. PATENT DOCUMENTS

| | | | |
|---|---|---|---|
| 2,892,195 | 6/1959 | Monetta | 2/9 |
| 3,170,164 | 2/1965 | Holder | 2/9 |
| 3,283,336 | 11/1966 | Critser . | |
| 3,815,152 | 6/1974 | Bednarczuk et al. . | |
| 3,854,146 | 12/1974 | Dunning . | |
| 3,889,296 | 6/1975 | Martin . | |
| 4,233,687 | 11/1980 | Lancellotti . | |
| 4,319,362 | 3/1982 | Ettinger . | |
| 4,587,677 | 5/1986 | Clement . | |
| 4,774,729 | 10/1988 | Coates et al. . | |
| 4,825,476 | 5/1989 | Andrews . | |
| 4,885,807 | 12/1989 | Snow, Jr. . | |
| 4,947,490 | 8/1990 | Hayden . | |
| 4,985,938 | 1/1991 | Snow, Jr. . | |
| 5,093,939 | 3/1992 | Noyerie et al. | 2/425 |

*Primary Examiner*—Michael A. Neas

[57] ABSTRACT

A facemask for a helmet which is of at least two parts and is split in the middle and resiliently mounted on the sides of the helmet. In accordance with the invention, the facemask will tend to open outwardly thereby increasing the likelihood that an opponent's grip on the facemask will be released. The facemask can be releasably mounted on the helmet so that, if the grip is not released, the portion of the facemask being grasped will then "break away" from the helmet. The force required to open up the two-part facemask is less than the force required to cause one or both parts of the facemask to be detached from the helmet. The present invention can be used with helmets for sports such as football, ice hockey, lacrosse, or other contact/collision sports.

18 Claims, 5 Drawing Sheets

RELEASABLE GRIP FACEMASK FOR HELMET

RELATED APPLICATIONS

This application is a continuation-in-part of International Application PCT/US96/16838, filed Oct. 17, 1996, which claims priority based on provisional application No. 60/005,769, filed Oct. 20, 1995. The full disclosures of these two applications are incorporated by reference herein.

FIELD OF THE INVENTION

The present invention relates to facemasks for helmets, particularly helmets used in contact/collision sports such as football and ice hockey.

BACKGROUND OF THE INVENTION

Facemasks for helmets have been used since the late 1940's or early 1950's. According to sports folklore, the football helmet face guard was invented by Paul Brown, legendary coach of the Cleveland Browns. The purpose of the facemask or face guard is to protect the wearer from objects such as hands or feet directed toward the face of the helmet wearer. However, a serious disadvantage of the football facemask is that it can be grasped by a would-be tackler with the potential for serious neck injury. As a result, grabbing the facemask is subject to a major penalty assessment (15 yards).

In the past, it was recognized that a releasable or "break-away" facemask would protect the helmet wearer by causing the facemask being grasped to be separated from the helmet. However, once this occurs, the wearer's face is exposed to contact with hands, feet or other objects directed toward the face. The prior art failed to address the desirability of causing the grip on the facemask to be released, rather than the facemask itself having to "break away" from the helmet.

SUMMARY OF THE INVENTION

The present invention overcomes the deficiencies of the prior art by providing a facemask which will cause the grip of a would-be tackler to be released. This is accomplished by a facemask which is of at least two parts and is split in the middle and resiliently mounted on the sides of the helmet. As a result, the facemask will tend to open outwardly at the location where the portions come together, thereby increasing the likelihood that an opponent's grip on the facemask will be released. The facemask can be releasably mounted on the helmet so that, if the grip is not released, the portion of the facemask being grasped will then "break away" from the helmet. The force required to open up the two-part facemask is less than the force required to cause one or both parts of the facemask to be released from the helmet. The facemask itself can have resilient portions or be mounted using resilient or elastic restoring members such as springs or rubber bands. The two sides of the facemask can be joined by releasable snaps. The split can be centered, offset from center or diagonally arranged. Rather than a plurality of connected individual bars, the right and left portions can be single unitary individual portions, preferably of a transparent or translucent material. A detachable center section can be provided between the left and right facemask portions. Stops can be provided to prevent the facemask portions from coming too close to the wearer's face when the portions close once the grip on the portions is released.

Although a football helmet is shown, the present invention can be used with other helmets for contact/collision sports such as ice hockey or lacrosse.

With the foregoing and other advantages and features of the invention that will become hereinafter apparent, the nature of the invention may be more clearly understood by reference to the following detailed description of the invention, the appended claims and to the several views illustrated in the attached drawings.

DETAILED DESCRIPTION OF THE INVENTION

Figure 1:
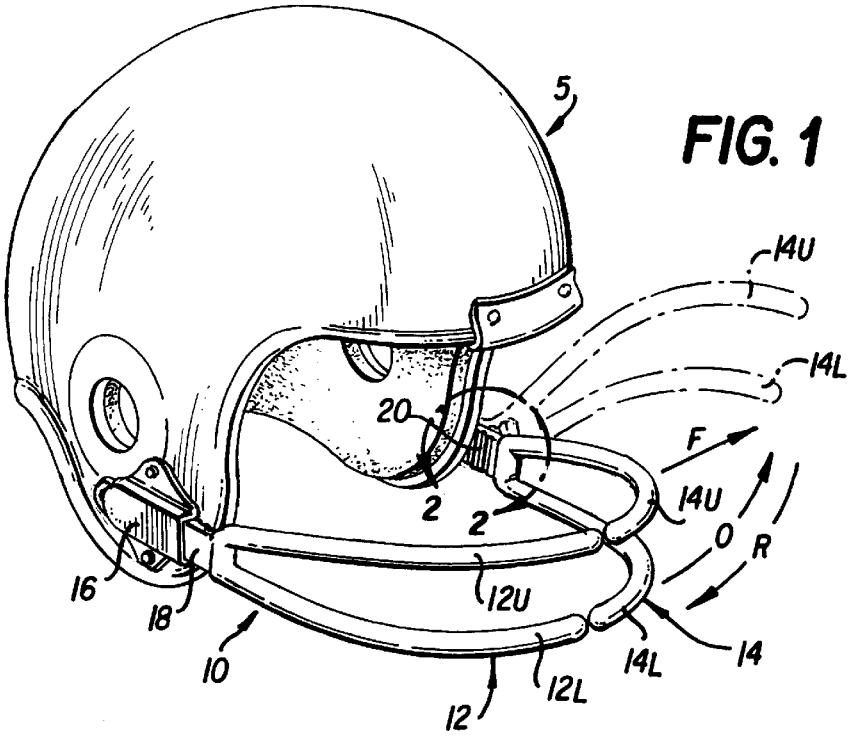
FIG. 1 is a perspective view of a football helmet having an openable, releasably mounted facemask according to a first embodiment of the invention.
Figure 4:
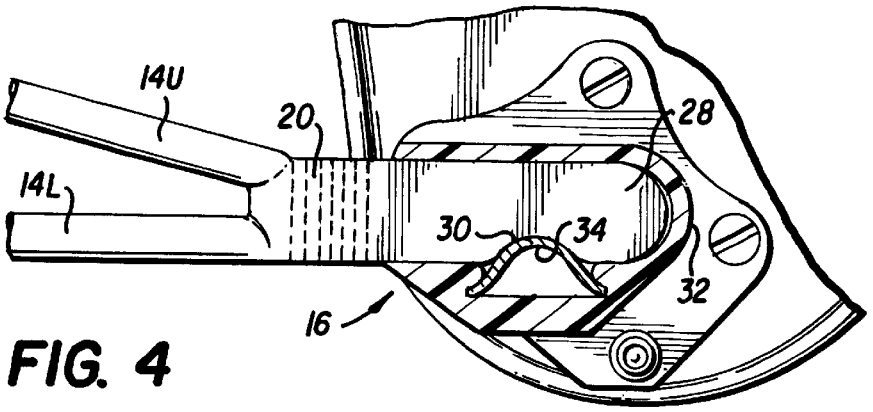
FIG. 4 is a detail view of the releasable mounting of the facemask to the helmet, according to the first embodiment.

Referring now to the drawings wherein like elements are designated by like numerals, FIG. 1 shows a perspective view of a football helmet designated generally by numeral 5 having a facemask 10 in accordance with a first embodiment of the invention. Facemask 10 is a two-part facemask having right piece 12 and left piece 14. Each piece 12, 14 has respective upper and lower bars 12U, 12L, 14U and 14L. Each piece 12, 14 is releasably attached to the helmet 5 by a leaf spring attachment 16 (FIG. 4). The upper and lower bars 12U, 12L and 14U, 14L are formed as respective unitary members 12, 14 and have respective resilient biasing portions 18, 20 integrally formed therein. Alternatively, the resilient biasing portions may be separately formed and attached to members 12 and 14.

Figure 2:
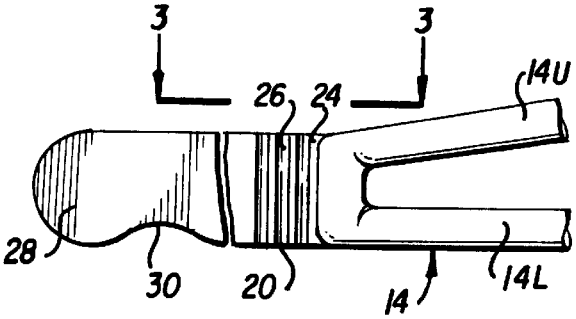
FIGS. 2 and 3 are detail views of a resilient portion of the facemask, according to the first embodiment, which permits the facemask to open when pulled on and then to restore when the pulling force is released.
Figure 3:
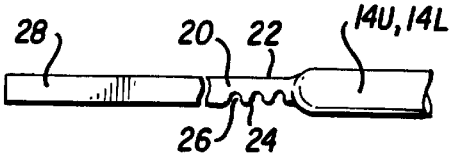

FIGS. 2 and 3 show a detail of the resilient biasing member 20 for left piece 14. Resilient biasing member 18 is similar to member 20 but symmetrically configured. Resilient biasing member 20 has one side 22 which is smooth and essentially uninterrupted and another side 24 which has grooves 26. As a result, the resilient biasing member 20 can flex when left piece 14 is pulled on so that the facemask can open up as shown by arrow O on FIG. 1. Once the opening force F is removed or the grip on the left piece 14 is released, the resilient member 20 will cause the left piece 14 to be restored to its initial, closed position (shown by arrow R). As shown in FIGS. 2 and 3, the smooth surface is on the outside and the grooves 26 on the inside (closer to the face). However, it is contemplated that the smooth surface can be located on the inside and the grooves 26 on the outside. Alternatively, it is contemplated that grooves can be provided on both sides or both sides can be smooth, so long as in any configuration, the facemask portion will tend to be restored to the closed position R once the grip is released.

FIG. 4 shows a detail of the releasable attachment 16. End piece 28 having detent 30 fits into slot 32 having leaf spring 34 which engages with detent 30. When a sufficiently great pulling force F is applied to either left piece 14 or right piece 12, the end 28 will slide over leaf spring 34, depressing leaf spring 34 and causing the piece 12, 14 to be released.

As a consequence, a pulling force F on the facemask 10 will cause the facemask 10 to open up as shown in FIG. 1. This provides a space in which the grasping hand can slide. This should result in the release of the grip on the facemask. However, if the grip on the facemask 10 is not released, then the piece 12, 14 of the facemask 10 is then released from the helmet ("breaks away"), thereby preventing the use of the facemask 10 as a handle for tackling. The resilient members 18, 20 are typically designed to have an opening/closing force which is less than the force causing the facemask piece 12, 14 to become detached from the helmet releasable attachment 16. Releasable attachment 16 is disclosed in U.S. Pat. No. 3,889,296, the teachings of which are incorporated by reference herein. A stop (not shown) can be provided on the inside to prevent the pivotal portion from being closed too close to the helmet wearer's face.

Figure 5:
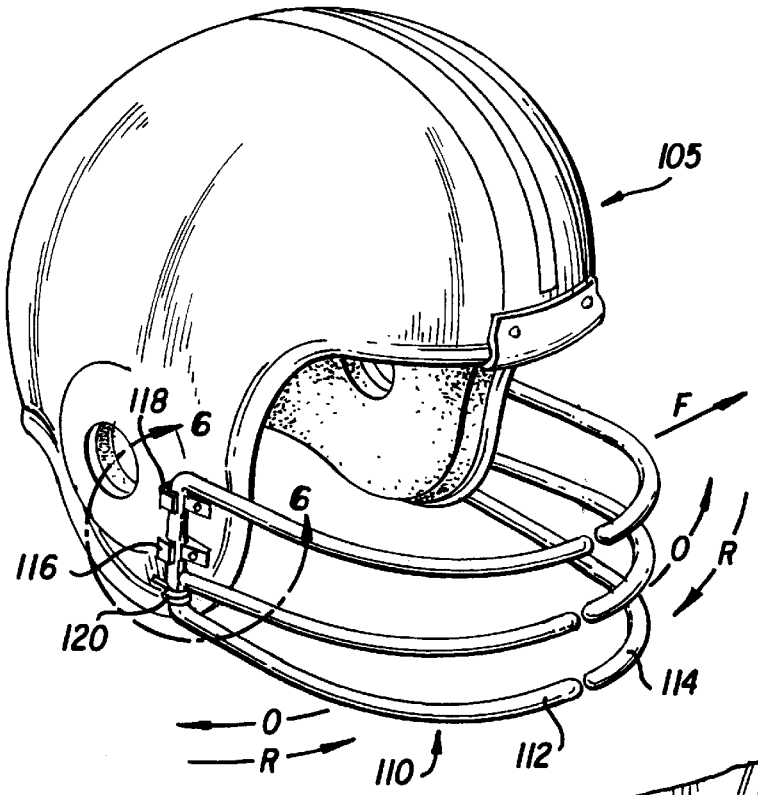
FIG. 5 is a perspective view of a football helmet having an openable, releasably mounted facemask according to a second embodiment of the invention.
Figure 6:
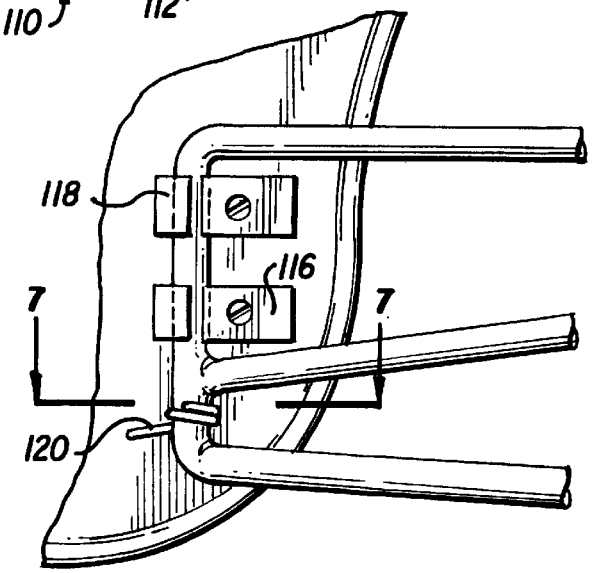
FIG. 6 is a detail view of the releasable mounting of the facemask to the helmet, according to the second embodiment.
Figure 7:
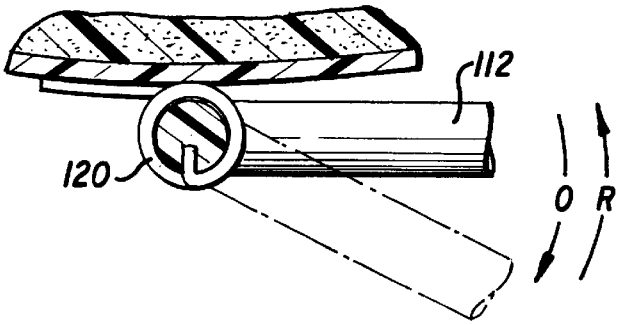
FIG. 7 is a detail view of the resilient mounting of the facemask, according to the second embodiment, which permits the facemask to open when pulled on and then to restore when the pulling force is released.

FIGS. 5–7 illustrate a second embodiment of a facemask 110 in accordance with the present invention. Helmet 105 includes facemask 110 with left and right pieces 114, 112. The facemask sections 114, 112 are pivotally mounted on the helmet by snap mounts 116, 118. A spring 120 is mounted on each of the facemask sections 114, 112 and serves to bias the facemask section to a closed position. When a gripping force F is applied to the facemask 110, the facemask portions will tend to open in direction O and will tend to close in the direction R when the gripping force F is released. Snap mounts 116, 118 serve to permit the facemask portions 114, 112 to be released from the helmet 105 if the gripping force is maintained. Snap mounts 116, 118 are similar to those disclosed in U.S. Pat. No. 4,233,687, the teachings of which are incorporated by reference herein.

Figure 8:
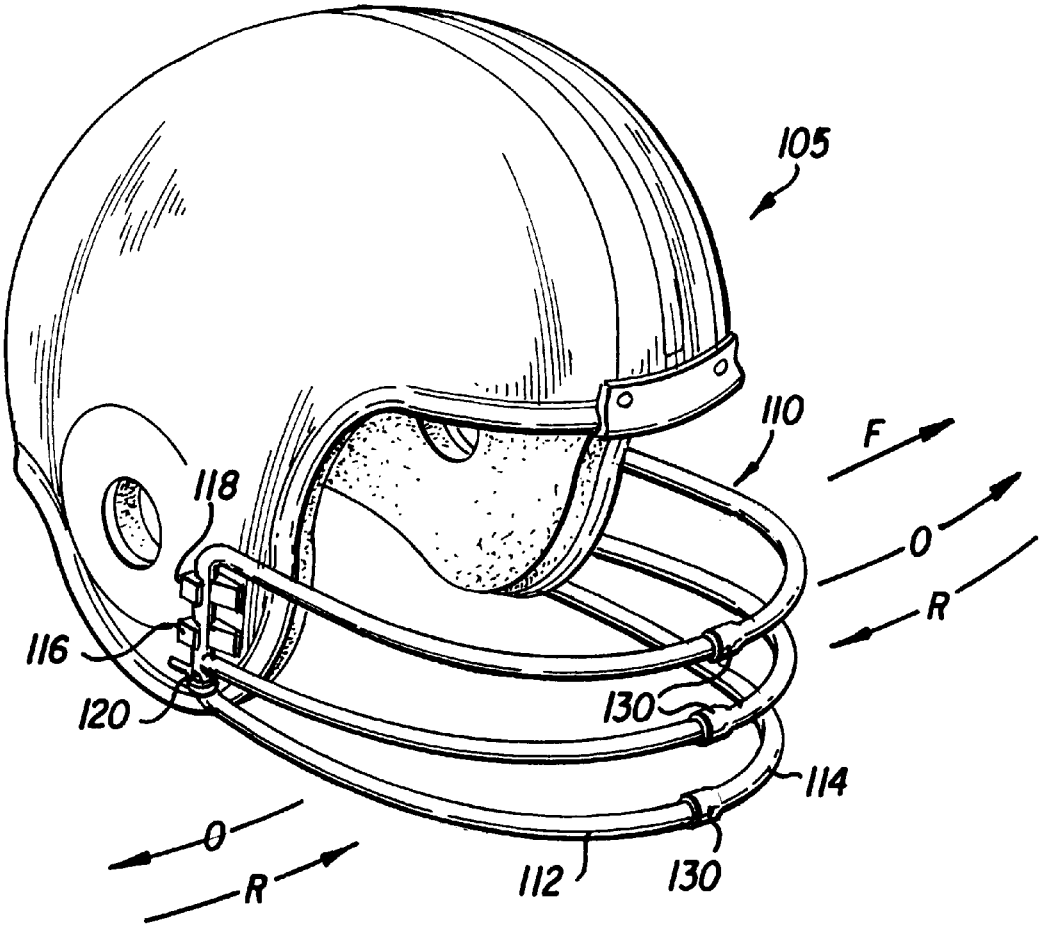
FIG. 8 is a perspective view of a football helmet according to the embodiment of FIG. 5 having snaps for holding the right and left portions of the facemask together.
Figure 9:
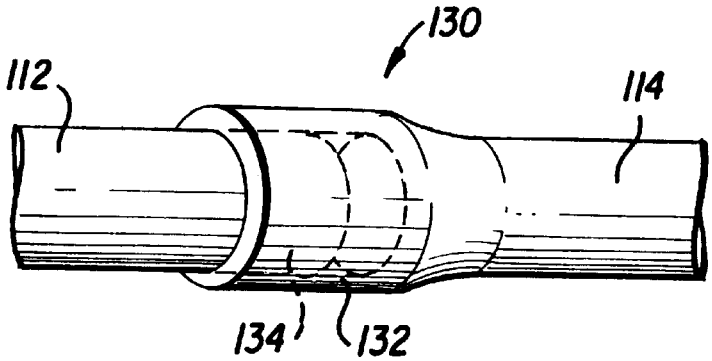
FIG. 9 is a detail view of a snap of FIG. 8.

FIGS. 8 and 9 show an embodiment according to the second embodiment of FIGS. 5–7 in which a snap element 130 is provided between the ends of each bar of right facemask portion 112 and left facemask portion 114. Snap element 130 is shown in detail in FIG. 9 in which male end 134 of right facemask portion 112 engages with female end 132 of left facemask portion 114. When facemask 110 is pulled on, the male end 134 will become disengaged from female end 132 permitting right and left facemask portions 112, 114 to open in direction O. Otherwise, the operation is the same as described above. The embodiment of FIG. 1 can also be provided with snaps similar to those shown in FIGS. 8 and 9.

Figure 10:
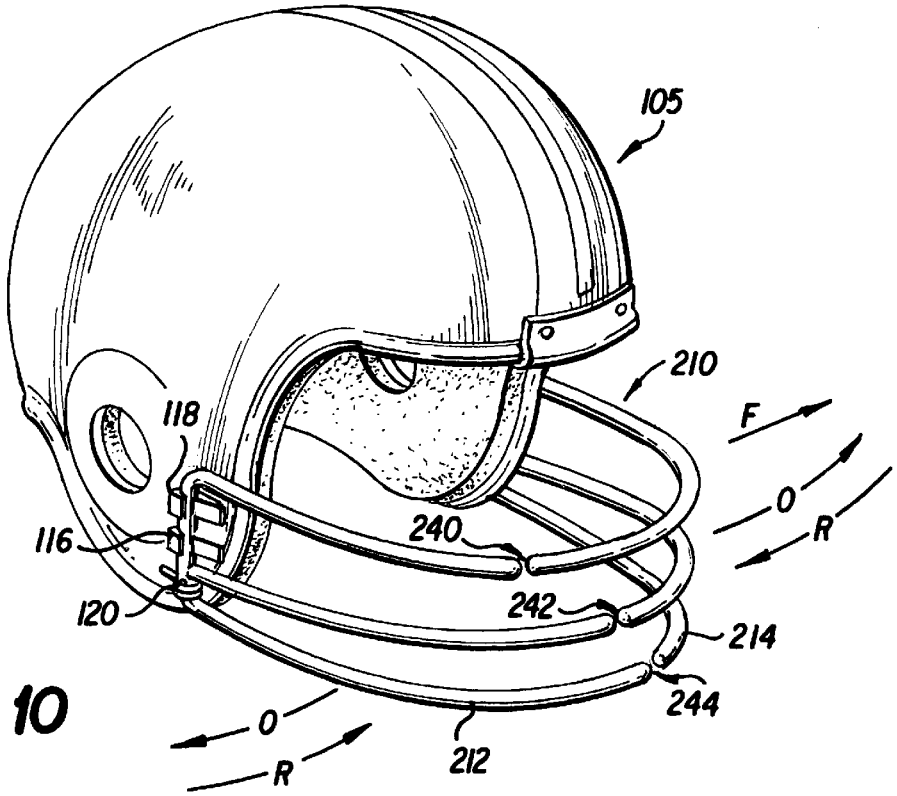
FIG. 10 is a perspective view of a football helmet showing a variation of the facemask according to the embodiment of FIG. 5 in which the split between the facemask portions is arranged diagonally across the facemask.

FIG. 10 shows a variation of a facemask according to the second embodiment in which the lengths of the bars on the right and left facemask portions vary, resulting in a staggered spacing between the ends of the facemask portions 212, 214. As shown in FIG. 10, the spaces 240, 242 and 244 are arranged diagonally across the facemask 210 rather than being centered, as shown in FIG. 5. When one of the facemask portions 212 or 214 becomes detached from the helmet 105, the remaining portion will provide greater coverage to the face. It is contemplated that other staggered configurations of variable spacing can be employed, such as the left and right portions having alternating greater and lesser lengths so as to provide greater coverage of the face if one portion becomes detached.

Figure 11:
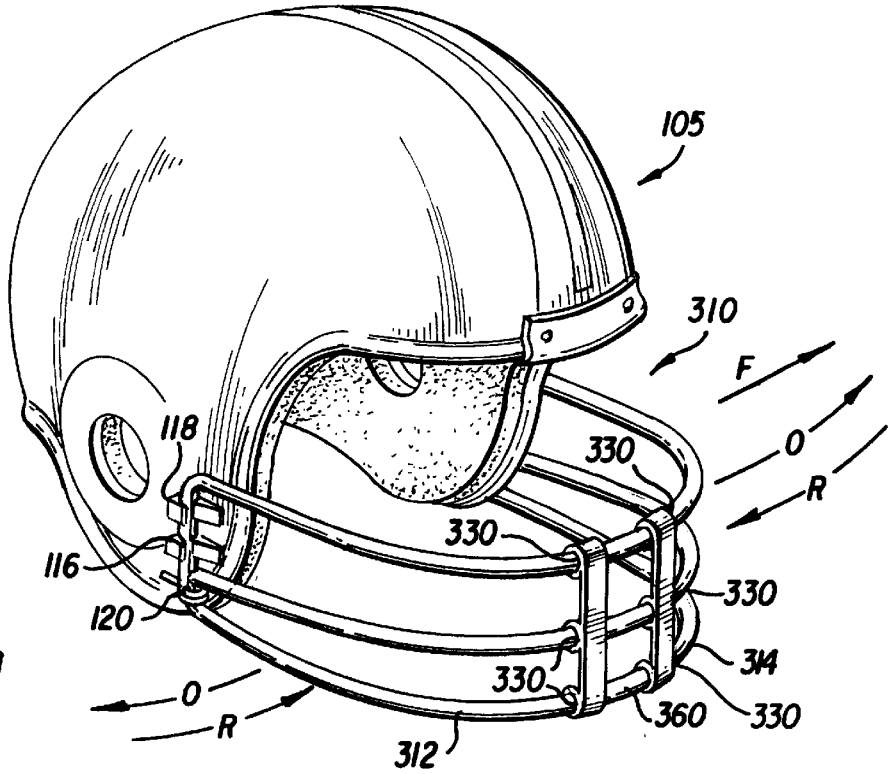
FIG. 11 is a perspective view of a football helmet having an openable, releasably mounted facemask having a detachable center portion, according to a third embodiment of the invention.

FIG. 11 shows a third embodiment of a facemask 310. Right and left facemask portions are provided similar to FIGS. 5, 8 and 10 and operate in the same manner. However, a center section 360 is provided detachably mounted to right and left portions 312,314 by snaps 330 similar to snaps 130 shown in FIG. 9. If center section 360 should be grasped by a would-be tackler, it becomes detached by the disengagement of the male ends of right and left facemask portions 312, 314 from the corresponding female ends of center section 360. As a result, both right and left facemask portions 312, 314 remain attached to the helmet 105 and provide greater coverage of the face. If a grip is maintained on one of the left or right facemask portions 314, 312, then that portion will detach from helmet 105.

Figure 12:
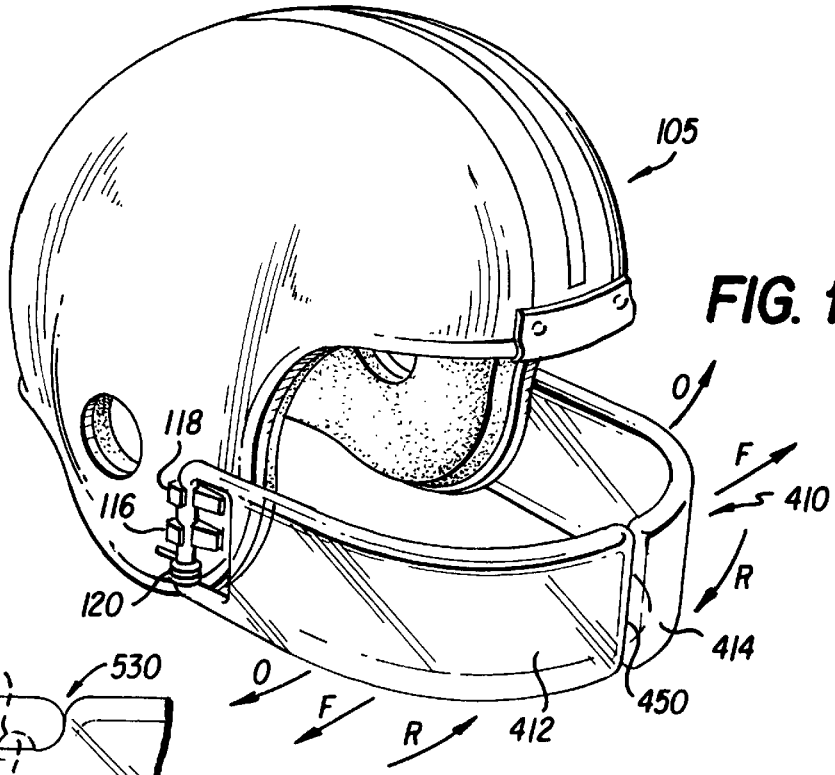
FIG. 12 is a perspective view of a football helmet having an openable, releasably mounted facemask having single individual right and left side parts which meet at the center of the facemask, according to a fourth embodiment of the invention.

FIG. 12 shows a fourth embodiment of a facemask 410 similar to FIG. 5 except that rather than a plurality of individual bars, there are two single unitary portions, right portion 412 and left portion 414 of facemask 410. The releasable mounting of the facemask portions 412, 414 is similar to that for the embodiment of FIG. 5. The two facemask portions 412, 414 are preferably made of a translucent or transparent material such as plastic to aid visibility. The two portions 412, 414 come together at the centerline 450 of the facemask 410. The two portions 412, 414 can be provided with one or more releasable snaps (not shown) similar to those shown in FIG. 14 below to join the two portions together.

Figure 14:
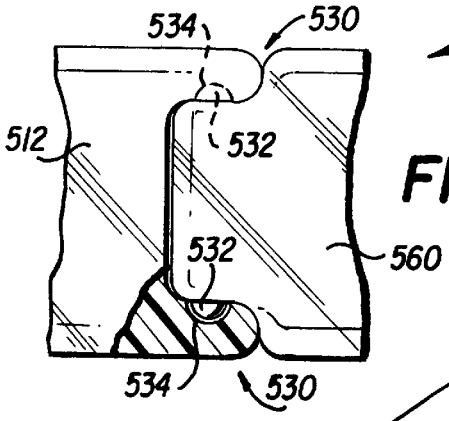
FIG. 14 is a detail view showing a snap arrangement for the detachable center portion of FIG. 13.
Figure 13:
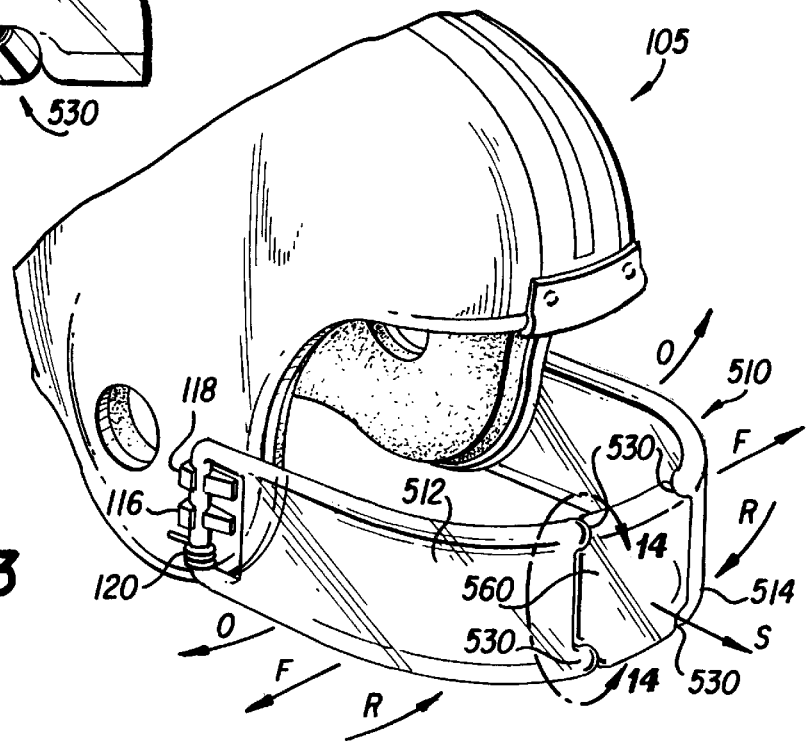
FIG. 13 is a perspective view of a football helmet having an openable, releasably mounted facemask having single individual right and left side parts with a detachable center portion, according to a fifth embodiment of the invention.

FIG. 13 shows a fifth embodiment of a facemask 510 similar to FIG. 11 except that rather than a plurality of individual bars, there are two single unitary portions 512, 514 of facemask 510 with a detachable center portion 560. Detachable center portion 560 is mounted to right and left portions 512, 514 by snaps 530. The material selection is preferably the same as for FIG. 12. A detail of snaps 530 is shown in FIG. 14. Snap 530 is made up of male knob or protrusion 532 engaging female concave depression 534.

Otherwise, the operation of the embodiment of FIG. 13 is similar to that of FIG. 11, in which center portion 560 detaches and separates as shown by arrow S and right portion 512 and left portion 514 are openable and closeable as shown by arrows O and R, respectively.

The facemasks 10, 110, 210, 310, 410, 510 can be made of any suitable material such as plastic, hard rubber or metal, so long as a resilient member can be incorporated in the facemask portion or a spring can be mounted on the facemask portion. Elastic members such as rubber bands can be used as resilient biasing members. The facemasks 10, 110, 210, 310 shown have a plurality of crossbar members, however, any number, one (as in 410, 510) or greater, can be utilized. Two different types of releasable helmet attachments are shown. However, other attachments are contemplated.

Although the facemask can be releasably mounted, it is contemplated that the facemask be permanently mounted and only resiliently openable and closable at the location where the separate portions come together. Similarly, it is contemplated that a detachable center portion be provided for a permanently mounted facemask which may or may not be openable and closable. It is contemplated that individual facemask bars can be detached, rather than the entire right or left portion. Finally, it is contemplated that stops can be provided to limit the extent of closure of the pivotal portions, once the opening force (or grip) is released.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A facemask for a helmet comprising at least one portion, means resiliently biasing and pivotally mounting said at least one portion outwardly away and inwardly toward the face of a wearer, said means allowing said at least one portion to be openable away from the face of the wearer when a pulling force is applied and closable by a resilient biasing force when the pulling force is released.

2. A facemask as in claim 1, wherein a portion of the facemask is detachably mounted to the helmet.

3. A facemask as in claim 1, wherein the facemask is comprised of a plurality of individual bars, each said bar resiliently biased and pivotally mounted, each said bar being openable when a pulling force is applied and closable when the pulling force is released.

4. A facemask comprising at least two portions, means for resiliently biasing and pivotally mounting each said portion outwardly away from the face of a wearer, said means allowing each said portion to be openable away from the fare of the wearer when a pulling force is applied and closable by a resilient biasing force when the pulling force is released.

5. A facemask as in claim 4, wherein the facemask portions come together at the center of the facemask when the facemask is in a closed configuration.

6. A facemask comprising at least two portions, means for resiliently biasing and pivotally mounting each said portion, said means allowing each said portion to be openable when a pulling force is applied and closable when the pulling force is released, wherein the facemask portions come together at the center of the facemask along a diagonal line when the facemask is in a closed configuration.

7. A facemask comprising a right portion, a left portion and a middle portion, means for resiliently biasing and pivotally mounting each said right portion and said left portion, said means allowing each said right and left portion to be openable when a pulling force is applied and closable when the pulling force is released, said middle portion being detachably mounted between said right and left portions.

8. A face mask comprising at least two portions, means for resiliently biasing and pivotally mounting each said portion outwardly away from and inwardly toward the face of a wearer, said means allowing each said portion to be openable away from the face of the wearer when a pulling force is applied and closable when the pulling force is released, wherein in said portions arc releasably connected together by snaps.

9. A protective headgear assembly comprising:

helmet, and a facemask comprising at least one portion, means for resiliently biasing and pivotally mounting said at least one portion outwardly away from and inwardly toward the face of the wearer, said means allowing said at least one portion to be openable away from the face of the wearer when a pulling force is applied and closable by a resilient biasing force when the pulling force is released.

10. A protective headgear assembly as in claim 9, wherein a portion of the facemask is detachably mounted to the helmet.

11. A protective headgear assembly as in claim 9, wherein the facemask is comprised of at least two portions, each said portion resiliently biased and pivotally mounted, each said portion being openable when a pulling force is applied and closable when the pulling force is released.

12. A protective headgear assembly as in claim 11, wherein the facemask portions come together at the center of the facemask when the facemask is in a closed configuration.

13. A protective headgear assembly as in claim 9, wherein the facemask is comprised of a plurality of individual bars, each said bar resiliently biased and pivotally mounted, each said bar being openable when a pulling force is applied and closable when the pulling force is released.

14. A protective headgear assembly comprising:

a helmet, and a facemask comprising at least two portions, means for resiliently biasing and pivotally mounting said at least two portions, said means allowing each said portion to be openable when a pulling force is applied and closable when the pulling force is released, wherein the facemask portions come together at the center of the facemask along a diagonal line when the facemask is in a closed configuration.

15. A protective headgear assembly comprising:

a helmet, and a facemask comprising a right portion, a left portion and a middle portion, means for resiliently biasing and pivotally mounting said right portion and said left portion, said means allowing each said right and left portion to be openable when a pulling force is applied and closable when the pulling force is released, said middle portion being detachably mounted between said right and left portions.

16. A protective headgear assembly comprising:

a helmet, and a facemask comprising at least two portions, means for resiliently biasing and pivotally mounting each said portion outwardly away from and inwardly toward the face of a wearer, allowing each said portion to be openable away from the face of the wearer when a pulling force is applied and closable when the pulling force is released, wherein said portions are releasably connected together by snaps.

17. A facemask for a helmet comprising a pair of portions, means for resiliently biasing and pivotally mounting each said portion, said means allowing said portions to be openable away from each other when a pulling force is applied and being closable by a resilient biasing force when the pulling force ceases.

18. A protective headgear assembly comprising:

a helmet, and a facemask attached to said helmet, said facemask comprising a pair of portions, means for resiliently biasing and pivotally mounting each said portion, said means allowing said portions to be openable away from each other when a pulling force is applied and being closable by a resilient biasing force when the pulling force ceases.

* * * * *